US011878837B2

(12) United States Patent
Endo et al.

(10) Patent No.: US 11,878,837 B2
(45) Date of Patent: Jan. 23, 2024

(54) SUPPORTER SURFACE HAVING PLATES

(71) Applicant: FUJIFILM Business Innovation Corp., Tokyo (JP)

(72) Inventors: Taisuke Endo, Kanagawa (JP); Hiroyuki Kono, Kanagawa (JP); Shigeru Tsukada, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 108 days.

(21) Appl. No.: 17/551,144

(22) Filed: Dec. 14, 2021

(65) Prior Publication Data

US 2023/0028458 A1 Jan. 26, 2023

(30) Foreign Application Priority Data

Jul. 20, 2021 (JP) ..... 2021-119208

(51) Int. Cl.
*B65D 19/44* (2006.01)

(52) U.S. Cl.
CPC .... *B65D 19/44* (2013.01); *B65D 2519/00815* (2013.01)

(58) Field of Classification Search
CPC ..... B65D 19/44; B65D 2519/00815
USPC ..... 108/57.12, 55.1, 55.3
See application file for complete search history.

(56) References Cited

U.S. PATENT DOCUMENTS 3,101,063 A * 8/1963 Wharton ..... B65D 19/40 108/55.1
3,275,131 A * 9/1966 Erickson ..... F16F 1/37 267/141
3,426,986 A * 2/1969 Pool ..... A47B 91/04 248/188
5,193,700 A * 3/1993 Lyman ..... B65D 19/44 206/386
5,413,054 A * 5/1995 Collins ..... B65D 19/44 108/55.3
5,911,179 A * 6/1999 Spiczka ..... B65D 19/0095 108/51.11
5,970,885 A * 10/1999 Polando ..... B65D 19/44 108/55.3
5,970,886 A * 10/1999 Knio ..... B65D 19/38 108/57.12
6,558,093 B1 * 5/2003 Arnold ..... B65D 19/0077 108/55.3
6,976,435 B2 * 12/2005 Lucas ..... B65D 71/0088 108/51.11

(Continued)

FOREIGN PATENT DOCUMENTS

JP H1095429 4/1998

*Primary Examiner* — Jose V Chen
(74) *Attorney, Agent, or Firm* — JCIPRNET

(57) ABSTRACT

A supporter includes: a first plate portion having a placement surface on which a support object is to be placed; a second plate portion that transmits downward a weight of the support object placed on the placement surface; a left third plate portion that is disposed between the first plate portion and the second plate portion and that extends diagonally in a direction such that a lower part thereof is separated further leftward; and a right third plate portion that is disposed between the first plate portion and the second plate portion on a right side of the left third plate portion and that extends diagonally in a direction such that a lower part thereof is separated further rightward.

20 Claims, 5 Drawing Sheets

(56) References Cited

U.S. PATENT DOCUMENTS

| | | | | |
|---|---|---|---|---|
| 7,555,879 | B1 * | 7/2009 | Utz | B65D 19/44 53/410 |
| 9,227,757 | B1 * | 1/2016 | Green | B65D 19/0095 |
| 2003/0037710 | A1 * | 2/2003 | Monson | B65D 19/0012 108/57.12 |
| 2007/0283858 | A1 * | 12/2007 | Ballard | B65D 19/0016 108/57.12 |
| 2011/0266177 | A1 * | 11/2011 | Lowry | B65D 19/44 53/399 |
| 2014/0090581 | A1 * | 4/2014 | Schultz | B65D 19/0095 248/634 |
| 2015/0056011 | A1 * | 2/2015 | Nakamura | B65D 19/20 403/408.1 |
| 2016/0061285 | A1 * | 3/2016 | Green | B65D 19/0028 267/141 |
| 2017/0210506 | A1 * | 7/2017 | Saliaris | B65D 85/66 |
| 2020/0024791 | A1 * | 1/2020 | Tobbe | D06F 39/001 |
| 2022/0348378 | A1 * | 11/2022 | Suruga | D21H 27/10 |
| 2023/0023277 | A1 * | 1/2023 | Tsukada | B65D 81/02 |
| 2023/0040304 | A1 * | 2/2023 | Suehiro | B65D 81/113 |

* cited by examiner

SUPPORTER SURFACE HAVING PLATES

CROSS-REFERENCE TO RELATED APPLICATIONS

This application is based on and claims priority under 35 USC 119 from Japanese Patent Application No. 2021-119208 filed Jul. 20, 2021.

BACKGROUND

(i) Technical Field

The present disclosure relates to a supporter.

(ii) Related Art

When shipping a heavy product, it is a common practice to place the product on a pallet and to transport the product by lifting the product together with the pallet by using a forklift.

In this case, the product is transported after performing the following operations: an operation of supporting the product on the pallet via a supporter, which is called a bracket, so that the product will not fall from the pallet during transportation; and an operation of interposing a cushioning member, such as Styrofoam, between the pallet and the product so that the product will not be scratched due to vibration.

Manpower and time are required to perform these operations before transportation, that is, the attachment of the bracket and setting of the cushioning member. Therefore, reduction of time for performing these operations is required in order to increase the efficiency of the transport operation.

Japanese Unexamined Patent Application Publication No. 10-095429 discloses ideas on a shape for fixing a bracket to an apparatus.

SUMMARY

Aspects of non-limiting embodiments of the present disclosure relate to a supporter having an improved cushioning ability compared with a case where third plate portions are not present on the left and right sides of a placement surface.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a supporter including: a first plate portion having a placement surface on which a support object is to be placed; a second plate portion that transmits downward a weight of the support object placed on the placement surface; a left third plate portion that is disposed between the first plate portion and the second plate portion and that extends diagonally in a direction such that a lower part thereof is separated further leftward; and a right third plate portion that is disposed between the first plate portion and the second plate portion on a right side of the left third plate portion and that extends diagonally in a direction such that a lower part thereof is separated further rightward.

BRIEF DESCRIPTION OF THE DRAWINGS

Exemplary embodiments of the present disclosure will be described in detail based on the following figures, wherein.

DETAILED DESCRIPTION

Hereafter, a comparative example will be described first, and then an exemplary embodiment of the disclosure will be described.

Figure 1A:
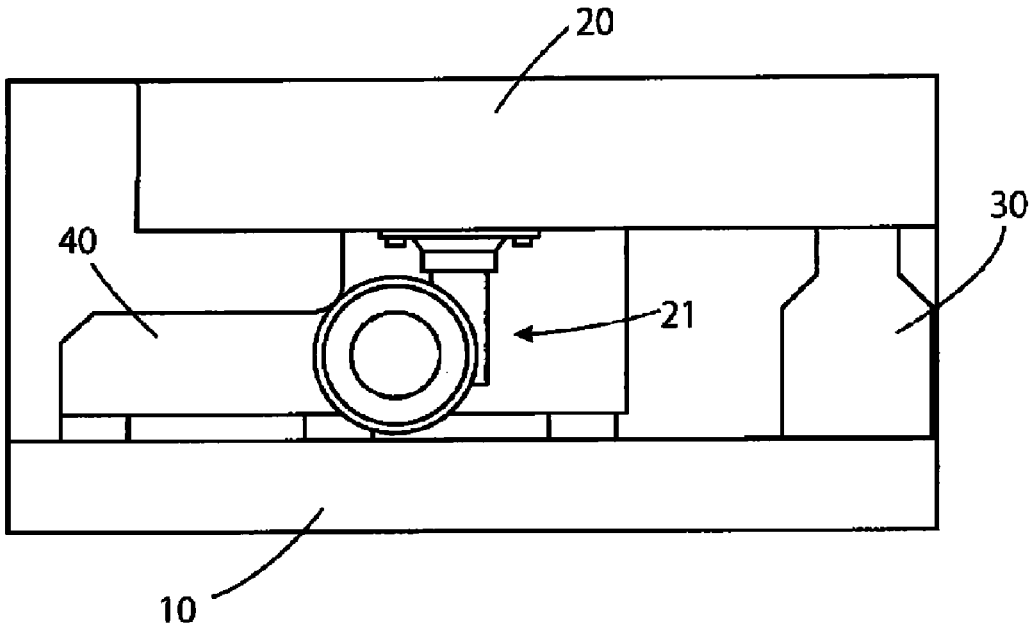
FIGS. 1A to 1C illustrate a method of supporting a support object on a pallet according to a comparative example.
Figure 1B:
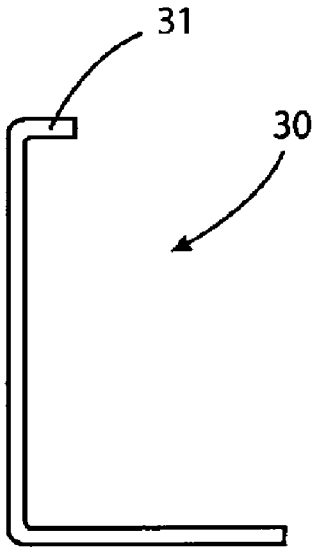
Figure 1C:
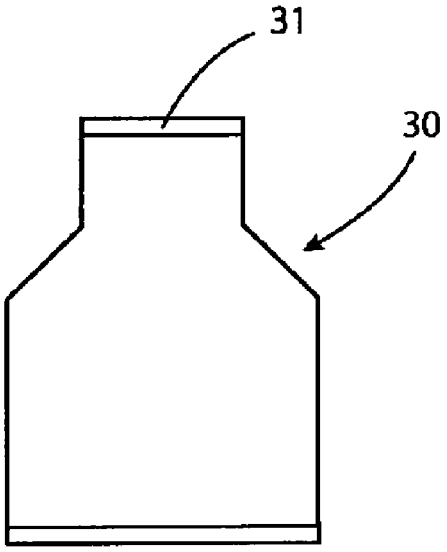

FIGS. 1A to 1C illustrate a comparative example of a method of supporting a support object on a pallet.

FIG. 1A illustrates a bottom part of an apparatus 20, which is an example of a support object placed on a pallet 10. The apparatus 20 includes a caster 21 in a lower part thereof. The apparatus 20 is protected by a bracket 30 for restricting horizontal shaking and the like and a cushioning member 40 as a cushion against vertical shaking, and is transported together with the pallet 10.

FIG. 1B is a side view and FIG. 1C is a front view of the bracket 30. The bracket 30 includes a hook portion 31, which is to be inserted into a support opening (not shown) of the apparatus 20, in an upper part thereof. The bracket 30 restricts horizontal shaking and the like of the apparatus 20 as the hook portion 31 is inserted into the support opening of the apparatus 20.

In the case of the comparative example, after the apparatus 20 has been placed on the pallet 10, it is necessary to use supporters of two types, which are the bracket 30 and the cushioning member 40, to support the apparatus 20. Therefore, it takes time to perform operations before transportation, and improvement of the efficiency of the operations is required.

Figure 2:
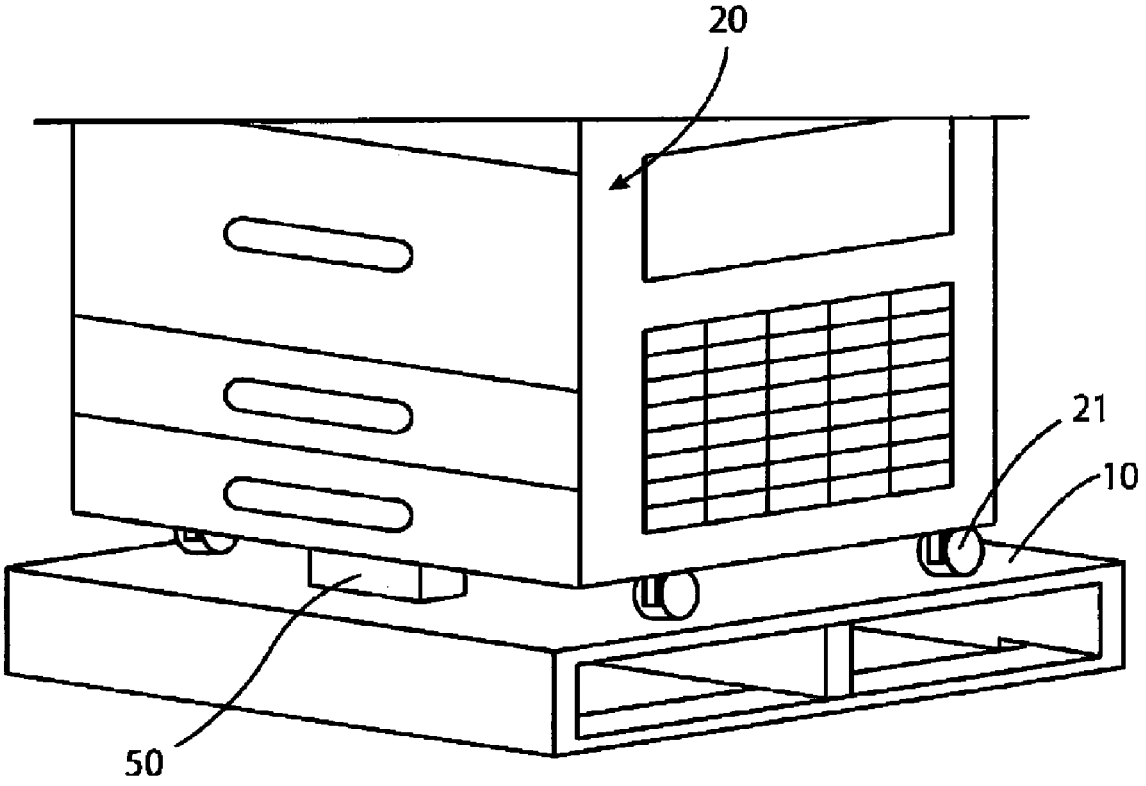
FIG. 2 illustrates an example of a method of supporting an apparatus on a pallet by using an example of a supporter according to an exemplary embodiment.

FIG. 2 illustrates an example of a method of supporting an apparatus on a pallet by using an example of a supporter according to an exemplary embodiment.

Also here, as in the case of the comparative example illustrated in FIG. 1A, the apparatus 20 having the caster 21 is placed on the pallet 10. The apparatus 20 is supported on the pallet 10 via a supporter 50, which is schematically illustrated in FIG. 2. Although only one supporter 50 is illustrated in FIG. 2, the apparatus 20 is supported by plural supporters 50 of the same type. The supporter 50 performs both of the function of the bracket 30 and the function of the cushioning member 40 illustrated in FIG. 1A.

Hereafter, the supporter 50 will be described.

Figure 3:
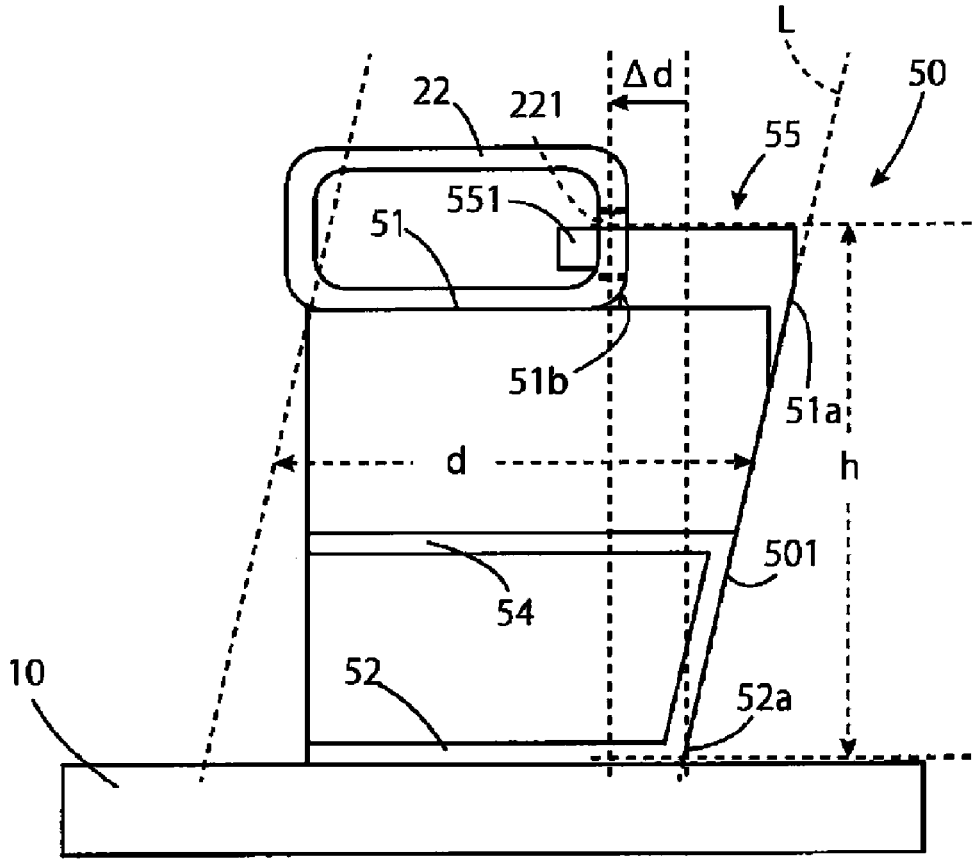
FIG. 3 is a side view of the supporter.
Figure 4:
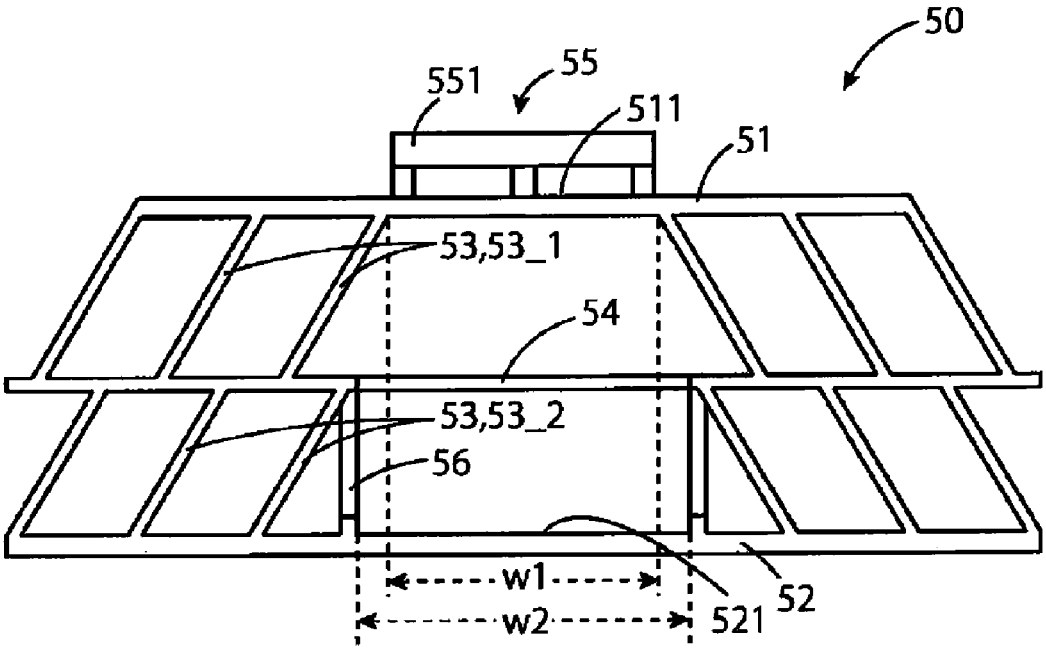
FIG. 4 is a front view of the supporter.

FIG. 3 is a side view and FIG. 4 is a front view of the supporter 50.

The supporter 50 is made of an integrally molded resin, which costs less than a combination of a plurality of parts.

Figure 5:
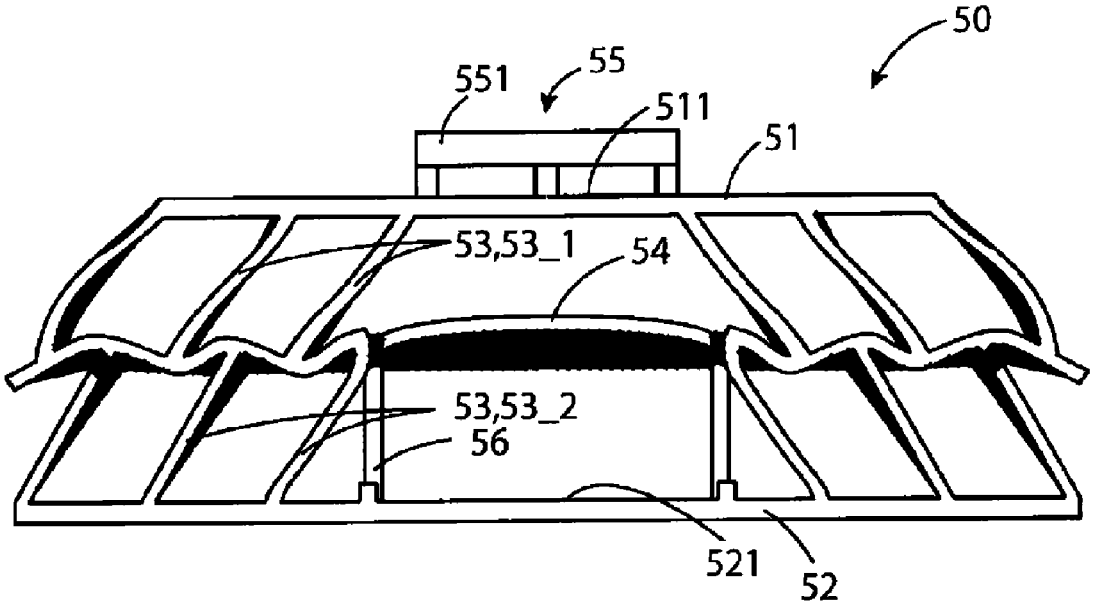
FIG. 5 is a front view of the supporter in a state in which a large load is applied to the supporter and the supporter is deformed due to the load.

FIG. 5 is a front view of the supporter 50 in a state in which a large load is applied to the supporter 50 and the supporter 50 is deformed due to the load.

Referring to FIGS. 3 and 4, the supporter 50 has the function of the bracket 30, which is illustrated in FIGS. 1A to 1C, in suppressing horizontal shaking of the apparatus 20. Moreover, when a large load is applied, the supporter 50 also functions as the cushioning member 40 illustrated in FIG. 1A by dispersing the load to the entirety of the supporter 50 as illustrated in FIG. 5. In this way, by using the supporter 50, it is possible to reduce time for performing operations before transporting the apparatus 20 placed on the pallet 10, compared with the supporting method illustrated in FIGS. 1A to 1C in which both of the bracket 30 and the cushioning member 40, which are members of different types, are used.

The supporter 50 includes an upper plate 51 and a lower plate 52, each of which extends horizontally.

The upper plate 51 has a placement surface 511 in a central part thereof in the left-right direction. As illustrated in FIG. 3, a support frame 22, which is a part of a bottom part of the apparatus 20 illustrated in FIG. 2, is placed on the placement surface 511.

The lower plate 52 transmits the weight of the apparatus 20, which is placed on the placement surface 511, to the pallet 10 below the lower plate 52.

The supporter 50 includes a plurality of support plates 53 between the upper plate 51 and the lower plate 52 on the right side and the left side of the placement surface 511.

The supporter 50 according to the present exemplary embodiment includes a middle plate 54 that extends horizontally between the upper plate 51 and the lower plate 52. Therefore, the support plates 53 include a first support plate 53_1, whose upper end is connected to the upper plate 51 and whose lower end is connected to the middle plate 54, and a second support plates 53_2, whose upper end is connected to the middle plate 54 and whose lower end is connected to the lower plate 52. These support plates 53, that is, the first support plate 53_1 and the second support plate 53_2 are located at positions displaced leftward and rightward from positions directly below the placement surface 511 and are diagonally disposed in directions such that lower parts thereof are separated further leftward and rightward from the placement surface 511. Moreover, a lower end of the first support plate 53_1 and an upper end of the second support plate 53_2 are connected to positions on the middle plate 54 that are alternately displaced with respect to the left-right direction.

It may be possible to directly connect the upper plate 51 and the lower plate 52 via the support plates 53 without providing the middle plate 54. However, in the present exemplary embodiment, because the middle plate 54 is provided and the positions of the lower end of the first support plate 53_1 and the upper end of the second support plate 53_2 differ from each other, the middle plate 54 between the lower end of the first support plate 53_1 and the upper end of the second support plate 53_2 also deforms. Therefore, cushioning ability is improved, compared with a structure in which the upper plate 51 and the lower plate 52 are directly connected or a case where the positions of the lower end of the first support plate 53_1 and the upper end of the second support plate 53_2 are the same.

The supporter 50 includes a shaking-suppressing portion 55 for suppressing horizontal shaking of the apparatus.

In the present specification, the phrase "suppress shaking" is used to express the meaning of suppressing horizontal shaking of a support object or supporting a support object in a horizontal direction by performing, for example, dispersion of a force, reinforcement, supporting, and the like.

The shaking-suppressing portion 55 includes a hook portion 551. The hook portion 551 protrudes forward to a position above the placement surface 511 with a space between the hook portion 551 and the placement surface 511. The hook portion 551 is inserted into a support opening 221 of the support frame 22 placed on the placement surface 511. The hook portion 551 of the shaking-suppressing portion 55 is inserted into the support opening 221 of the support frame 22, and thereby the shaking-suppressing portion 55 suppresses horizontal shaking of the apparatus 20 (see FIG. 2) including the support frame 22. In this way, because the supporter 50 according to the present exemplary embodiment includes the shaking-suppressing portion 55, the supporter 50 can reliably support the apparatus 20, compared with a structure that does not have the shaking-suppressing portion 55.

The supporter 50 further includes a pair of standing plates 56. The lower plate 52 of the supporter 50 has an open region 521 that includes a region of shadow of the shaking-suppressing portion 55 having a width w1 that is created when the shaking-suppressing portion 55 is projected onto the lower plate 52 from a direction perpendicular to the lower plate 52, that spreads leftward and rightward beyond the region of shadow, where the second support plates 53_2 is not present, and that has a width w2. The pair of standing plates 56 are disposed on the left and right sides of the open region 521 in such a way as to extend in the vertical direction. Because the supporter 50 according to the present exemplary embodiment includes the standing plates 56 on both sides of the open region 521 having a larger width than the shaking-suppressing portion 55, the supporter 50 can stably support the apparatus 20 compared with a case where the width w2 of the open region 521 is smaller than the width w1 of the shaking-suppressing portion 55.

The standing plate 56 on the left side of the open region 521 may extend in a direction opposite to the second support plate 53_2 on the left side thereof, that is, diagonally in a direction such that a lower part thereof is separated further rightward. Likewise, the standing plate 56 on the right side of the open region 521 may extend in a direction opposite to the second support plate 53_2 on the right side thereof, that is, diagonally in a direction such that a lower part thereof is separated further leftward.

The upper plate 51 and the lower plate 52 respectively correspond to an example of a first plate portion and an example of a second plate portion according to the present disclosure. The support plate 53, the first support plate 53_1, and the second support plate 53_2 respectively correspond to an example of a third plate portion, an example of a first left third plate portion, and an example of a second left third plate portion according to the present disclosure. The middle plate 54, the shaking-suppressing portion 55, the hook portion 551, and the standing plate 56 respectively correspond to an example of a fourth plate portion, an example of a shaking-suppressing portion, an example of a hook portion, and an example of a fifth plate portion according to the present disclosure.

Next, referring basically to FIG. 3, the shape of the supporter 50 in a side view will be described.

The dimension d of the supporter 50 in the front-back direction is smaller than the height dimension h of the supporter 50. The dimension d in the front-back direction is set to a dimension that allows the supporter 50 in a laid position, which is a position such that the dimension d becomes a height dimension, to be inserted into a space below the apparatus 20 placed on the pallet 10. Thus, after inserting the supporter 50 into the space, it is possible to attach the supporter 50 in a standing position illustrated in FIG. 3.

The supporter 50 has a back surface 501 that diagonally extends along a straight line L in such a way that an edge 51*a* of the upper plate 51 on the back surface side is positioned behind an edge 52*a* of the lower plate 52 on the back surface side. Because the back surface 501 extends diagonally, compared with a case where the back surface extends vertically, there is a sufficient space for disposing the shaking-suppressing portion 55 while reducing the dimension d in the front-back direction.

Moreover, in the supporter 50, an edge 51*b* of the placement surface 511 on the back surface 501 side is positioned in front of the edge 52*a* of the lower plate 52 on the back surface 501 side by a distance Δd. Thus, the placement surface 511 can support the support object (here, the support frame 22) stably, compared with a case where the edge 51*b* of the placement surface 511 on the back surface 501 side is positioned behind the edge 52*a* of the lower plate 52 on the back surface 501 side.

The supporter 50 according to the exemplary embodiment described above includes the middle plate 54. The middle plate 54 contributes to improvement of the cushioning ability of the supporter 50. However, the middle plate 54 may be omitted, and the upper plate 51 and the lower plate 52 may be directly connected to each other via the support plates 53. In this case, as illustrated in FIG. 4, it is necessary to dispose the support plates 53 diagonally in order to disperse a load.

On the other hand, when the middle plate 54 is provided, the support plates 53, that is, the first support plate 53_1 and the second support plate 53_2 may stand perpendicularly with respect to the upper plate 51 or the lower plate 52. In this case, it is necessary that the first support plate 53_1 and the second support plate 53_2 be connected to positions on the middle plate 54 that differ from each other in the left-right direction. It is possible to provide the supporter 50 with cushioning ability by connecting the first support plate 53_1 and the second support plate 53_2 to different positions on the middle plate 54.

The supporter 50 according to the exemplary embodiment described above includes one middle plate 54 between the upper plate 51 and the lower plate 52. However, the supporter 50 may include two or more middle plates, and these middle plates may be connected via the support plates 53.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A supporter comprising:

a first plate portion having a placement surface;

a second plate portion that transmits downward a weight placed on the placement surface;

a left third plate portion that is disposed between the first plate portion and the second plate portion and that extends diagonally in a direction such that a lower part thereof is separated further leftward;

a right third plate portion that is disposed between the first plate portion and the second plate portion on a right side of the left third plate portion and that extends diagonally in a direction such that a lower part thereof is separated further rightward; and a fourth plate portion that extends leftward and rightward between the first plate portion and the second plate portion.

2. The supporter according to claim 1, wherein the left third plate portion includes:

a first left third plate portion that has a lower end connected to the fourth plate portion and that extends diagonally upward and rightward; and a second left third plate portion that has an upper end connected to the fourth plate portion and that extends diagonally downward and leftward, wherein the lower end of the first left third plate portion and the upper end of the second left third plate portion are connected to positions that differ from each other with respect to a left-right direction of the fourth plate portion, wherein the right third plate portion includes:

a first right third plate portion that has a lower end connected to the fourth plate portion and that extends diagonally upward and leftward; and a second right third plate portion that has an upper end connected to the fourth plate portion and that extends diagonally downward and rightward, and wherein the lower end of the first right third plate portion and the upper end of the second right third plate portion are connected to positions that differ from each other with respect to the left-right direction of the fourth plate portion.

3. The supporter according to claim 2, further comprising:

a shaking-suppressing portion that includes a hook portion protruding forward to a position above the placement surface with a space between the hook portion and the placement surface, the shaking-suppressing portion suppressing shaking of a support frame placed on the placement surface as the hook portion is inserted into a support opening of the support frame placed on the placement surface.

4. The supporter according to claim 3, wherein the second plate portion has an open region that includes a region of shadow of the shaking-suppressing portion that is created when the shaking-suppressing portion is projected onto the second plate portion from a direction perpendicular to the second plate portion, that spreads leftward and rightward beyond the region of shadow, and where the left third plate portion and right third plate portion are not present, the supporter further comprising:

a left fifth plate portion that is disposed on a left side of the open region and that extends in the direction perpendicular to the second plate portion or extends diagonally in a direction such that a lower part thereof is separated further rightward; and a right fifth plate portion that is disposed on a right side of the open region and that extends in the direction perpendicular to the second plate portion or extends diagonally in a direction such that a lower part thereof is separated further leftward.

5. The supporter according to claim 4, wherein a dimension of the supporter in a front-back direction is smaller than a height dimension of the supporter.

6. The supporter according to claim 3, wherein a dimension of the supporter in a front-back direction is smaller than a height dimension of the supporter.

7. The supporter according to claim 2, wherein a dimension of the supporter in a front-back direction is smaller than a height dimension of the supporter.

8. The supporter according to claim 1, further comprising:

a shaking-suppressing portion that includes a hook portion protruding forward to a position above the placement surface with a space between the hook portion and the placement surface, the shaking-suppressing portion suppressing shaking of a support frame placed on the placement surface as the hook portion is inserted into a support opening of the support frame placed on the placement surface.

9. The supporter according to claim 8, wherein the second plate portion has an open region that includes a region of shadow of the shaking-suppressing portion that is created when the shaking-suppressing portion is projected onto the second plate portion from a direction perpendicular to the second plate portion, that spreads leftward and rightward beyond the region of shadow, and where the left third plate portion and right third plate portion are not present, the supporter further comprising:

a left fifth plate portion that is disposed on a left side of the open region and that extends in the direction perpendicular to the second plate portion or extends diagonally in a direction such that a lower part thereof is separated further rightward; and a right fifth plate portion that is disposed on a right side of the open region and that extends in the direction perpendicular to the second plate portion or extends diagonally in a direction such that a lower part thereof is separated further leftward.

10. The supporter according to claim 9, wherein a dimension of the supporter in a front-back direction is smaller than a height dimension of the supporter.

11. The supporter according to claim 8, wherein a dimension of the supporter in a front-back direction is smaller than a height dimension of the supporter.

12. The supporter according to claim 1, wherein a dimension of the supporter in a front-back direction is smaller than a height dimension of the supporter.

13. The supporter according to claim 12, wherein a back surface of the supporter is diagonally formed, by extending along a straight line, in such a way that an edge of the first plate portion on a back surface side is positioned behind an edge of the second plate portion on the back surface side by a distance.

14. The supporter according to claim 13, wherein an edge of the placement surface on the back surface side is positioned in front of the edge of the second plate portion on the back surface side.

15. The supporter according to claim 1, wherein the supporter is made of an integrally molded resin.

16. A supporter comprising:

a first plate portion having a placement surface;

a second plate portion that transmits downward a weight placed on the placement surface;

a left third plate portion that is disposed between the first plate portion and the second plate portion and that extends upward and downward; and a right third plate portion that is disposed between the first plate portion and the second plate portion on a right side of the left third plate portion and that extends upward and downward; and a fourth plate portion that extends leftward and rightward between the first plate portion and the second plate portion, wherein the left third plate portion includes:

a first left third plate portion that is disposed between the first plate portion and the fourth plate portion, that has a lower end connected to the fourth plate portion, and that extends upward; and a second left third plate portion that is disposed between the fourth plate portion and the second plate portion, that has an upper end connected to the fourth plate portion, and that extends downward, wherein the lower end of the first left third plate portion and the upper end of the second left third plate portion are connected to positions that differ from each other with respect to a left-right direction of the fourth plate portion, and wherein the right third plate portion includes:

a first right third plate portion that is disposed between the first plate portion and the fourth plate portion, that has a lower end connected to the fourth plate portion, and that extends upward; and a second right third plate portion that is disposed between the fourth plate portion and the second plate portion, that has an upper end connected to the fourth plate portion, and that extends downward; and wherein the lower end of the first right third plate portion and the upper end of the second right third plate portion are connected to positions that differ from each other with respect to the left-right direction of the fourth plate portion.

17. The supporter according to claim 16, further comprising:

a shaking-suppressing portion that includes a hook portion protruding forward to a position above the placement surface with a space between the hook portion and the placement surface, the shaking-suppressing portion suppressing shaking of a support frame placed on the placement surface as the hook portion is inserted into a support opening of the support frame placed on the placement surface.

18. The supporter according to claim 17, wherein the second plate portion has an open region that includes a region of shadow of the shaking-suppressing portion that is created when the shaking-suppressing portion is projected onto the second plate portion from a direction perpendicular to the second plate portion, that spreads leftward and rightward beyond the region of shadow, and where the left third plate portion and right third plate portion are not present, the supporter further comprising:

a left fifth plate portion that is disposed on a left side of the open region and that extends in the direction perpendicular to the second plate portion or extends diagonally in a direction such that a lower part thereof is separated further rightward; and a right fifth plate portion that is disposed on a right side of the open region and that extends in the direction perpendicular to the second plate portion or extends diagonally in a direction such that a lower part thereof is separated further leftward.

19. The supporter according to claim 17, wherein a dimension of the supporter in a front-back direction is smaller than a height dimension of the supporter.

20. The supporter according to claim 16, wherein a dimension of the supporter in a front-back direction is smaller than a height dimension of the supporter.

* * * * *